US006538393B2

(12) United States Patent
Buij et al.

(10) Patent No.: US 6,538,393 B2
(45) Date of Patent: Mar. 25, 2003

(54) CIRCUIT ARRANGEMENT

(75) Inventors: Arnold Willem Buij, Eindhoven (NL); Marcel Beij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/022,171

(22) Filed: Oct. 30, 2001

(65) Prior Publication Data

US 2002/0101187 A1 Aug. 1, 2002

(30) Foreign Application Priority Data

Nov. 2, 2000 (EP) ..... 00203829

(51) Int. Cl.[7] ..... G05F 1/00
(52) U.S. Cl. ..... 315/224; 315/291
(58) Field of Search ..... 315/224, 225, 315/291, 307, 308, 158

(56) References Cited

U.S. PATENT DOCUMENTS 5,523,656 A * 6/1996 Luursema ..... 315/308
5,969,482 A * 10/1999 Gradzki ..... 315/224
6,094,016 A * 7/2000 Luger et al. ..... 315/295
6,188,177 B1 * 2/2001 Adamson et al. ..... 315/149
6,191,568 B1 * 2/2001 Poletti ..... 323/268

* cited by examiner

*Primary Examiner*—Don Wong
*Assistant Examiner*—D A Minh

(57) ABSTRACT

In an electronic ballast equipped with a digital lamp power control loop, the gain is controlled in dependence on the signs of consecutive error signals and the absolute values of these signals. The digital control loop is stable and comparatively fast for a wide range of values of the power consumed by the lamp.

8 Claims, 2 Drawing Sheets

CIRCUIT ARRANGEMENT

BACKGROUND OF THE INVENTION

The invention relates to a circuit arrangement for supplying a lamp, provided with input terminals for connection to a supply voltage source, a first circuit portion I for generating a current through the lamp from the supply voltage delivered by the supply voltage source, a digital control loop controlling an operational parameter to a desired value, provided with a sample circuit portion for sampling the actual value of the operational parameter with a predetermined frequency f, and a control circuit portion for generating a control signal whose most recent value is $U_n$, provided with an integrating circuit portion for augmenting $U_{n-1}$ with $K^*E_n$, with $U_{n-1}$ being the most recent value but one of the control signal, $E_n$ being the most recent value of an error signal which is a measure for the actual value of the operational parameter minus a desired value of the operational parameter, and K being a proportionality factor.

Such a control loop is called an integrating control loop. The operational parameter controlled by the digital control loop may be, for example, the lamp current or the power consumed by the lamp. It is desirable that the control loop should be stable at any ambient temperature, and also for any power consumed by the lamp if the circuit arrangement offers the user the possibility of adjusting the lamp power. To achieve that the control loop is stable at low values of the power consumed by the lamp, it is often necessary to choose the value of the proportionality factor K to be low. A disadvantage of such a low value of the proportionality factor K is, however, that the response of the control loop is slow, so that it takes a comparatively long time before a change in the desired value of the operational parameter will have achieved a corresponding change in the actual value of the operational parameter.

The invention has for its object to provide a circuit arrangement in which the control loop is stable and at the same time comparatively fast for widely varying values of parameters such as the ambient temperature the value of the power consumed by the lamp.

BRIEF SUMMARY OF THE INVENTION

According to the invention, a circuit arrangement of the kind mentioned in the opening paragraph is for this purpose provided with a second circuit portion II for influencing the value of the proportionality factor K, provided with a memory for storing the most recent value $E_n$ of the error signal and a most recent value but one $E_{n-1}$ of the error signal, a comparator for determining the sign of each of the values of the error signal $E_n$ and $E_{n-1}$, a circuit portion III for increasing the proportionality factor K if the values $E_n$ and $E_{n-1}$ have the same sign, and a circuit portion IV for reducing the proportionality factor K if the values $E_n$ and $E_{n-1}$ have unequal signs.

If two consecutive values of the error signal have opposite signs, this points to an unstable behavior of the control loop. The circuit portion IV in that case reduces the proportionality factor K. If two consecutive values of the error signal have the same sign, this suggests that the control loop is comparatively slow. The circuit portion III in that case increases the proportionality factor K.

The operation of the circuit portion III and the circuit portion IV adjusts the proportionality factor K to a value at which the control loop is stable and at the same time comparatively fast.

The invention may be applied with good results in a circuit arrangement with an integrating digital control loop, in other words a control loop in which the most recent value but one $U_{n-1}$ of the control signal is augmented with the term $K^*E_n$ at the predetermined frequency such that it is true that $U_n=U_{n-1}+K^*E_n$. Good results were also found for embodiments of a circuit arrangement according to the invention in which the control circuit portion augments the last value but one of the control signal $U_{n-1}$ not only with the term $K^*E_n$ but also with one or several other terms. More in particular, good results were obtained for embodiments of a circuit arrangement according to the invention provided with a proportional/integrating control loop, i.e. a control loop in which the control circuit portion is in addition provided with a proportional circuit portion for augmenting the most recent value but one of the control signal $U_{n-1}$ with $P^*(E_n-E_{n-1})$, in which P is a proportionality factor. It is true for such a control loop that $U_n=U_{n-1}+K^*E_n+P^*(E_n-E_{n-1})$. It was found to be advantageous in such embodiments to provide the circuit portion III in addition with means for increasing the proportionality factor P if the values of $E_n$ and $E_{n-1}$ have the same sign, and to provide the circuit portion IV in addition with means for reducing the proportionality factor P if the values of $E_n$ and $E_{n-1}$ have unequal signs.

It was found that a further stabilization of the digital control loop can be achieved in a circuit arrangement according to the invention in that the circuit portion III is provided with an activation circuit portion for activating the circuit portion III if an absolute value of the error signal, for example the absolute value of $E_n$ or the absolute value of $E_{n-1}$, is greater than a preset value.

In a similar manner, a further stabilization of the digital control loop can be achieved in a circuit arrangement according to the invention in that the circuit portion IV is provided with an activation circuit portion for activating the circuit portion IV if an absolute value of the error signal, for example the absolute value of $E_n$ or the absolute value of $E_{n-1}$, is greater than a preset value.

The circuit portion III of a circuit arrangement according to the invention may be constructed in a comparatively simple manner if the circuit portion III comprises means for multiplying one or more of the proportionality factors K and P by a predetermined value C1 greater than 1 if the values of $E_n$ and $E_{n-1}$ have the same sign, and the circuit portion IV comprises means for multiplying one or more of the proportionality factors K and P by a predetermined value C2 smaller than 1 if the values of $E_n$ and $E_{n-1}$ have unequal signs.

Since any instability of the control loop is to be quickly remedied whereas slowness of the control loop forms a less serious problem, the predetermined values C1 and C2 are chosen such that it is true that $1-C2>C1-1$. It is achieved thereby that the circuit portion IV makes the proportionality factor smaller comparatively quickly in the case of instabilities, whereas the circuit portion III makes the proportionality factor K greater comparatively slowly in the case of a slow response. It was found that such a choice of the predetermined values C1 and C2 contributes to the stability of the control loop.

It was found to be advantageous to provide the circuit portion II with a microprocessor because a major portion of the functions of the circuit portion II can be carried out thereby in a comparatively simple and thus inexpensive manner.

An embodiment of the invention will now be explained in more detail with reference to a drawing.

DETAILED DESCRIPTION OF THE INVENTION

Figure 1:
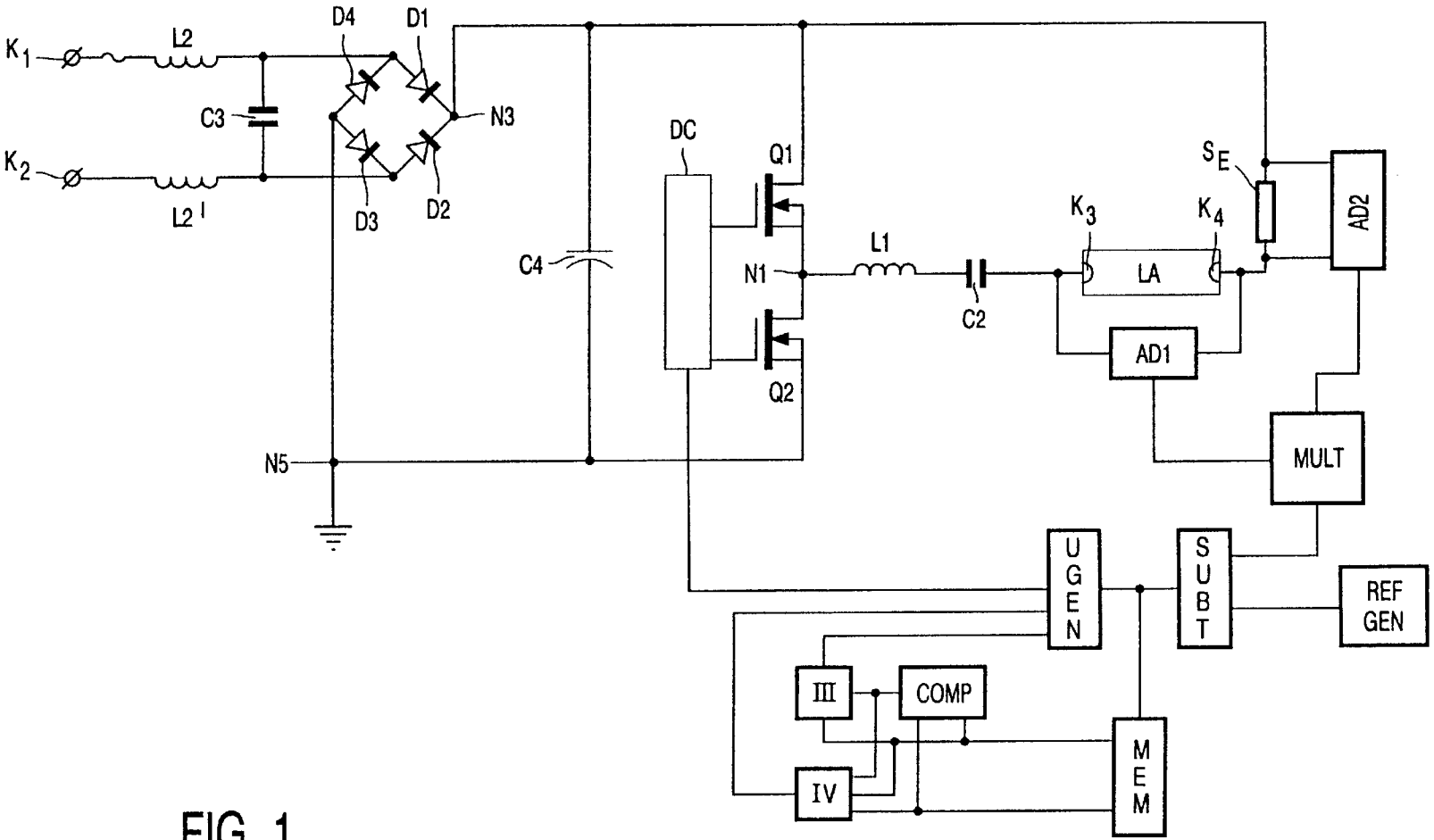
FIG. 1 diagrammatically shows an embodiment of a circuit arrangement according to the invention with a lamp connected thereto.

In FIG. 1, K1 and K2 are input terminals for connection to a supply voltage source. The embodiment shown in FIG. 1 is suitable for connection to a supply voltage source which delivers a low-frequency AC voltage. The input terminals K1 and K2 are interconnected by a series arrangement of a coil L2, a capacitor C3, and a coil L2'. The coils L2 and L2' and the capacitor C2 together form an input filter for the suppression of interference in the supply voltage source. A common junction point of the coil L2 and the capacitor C2 is connected to a first input of a diode bridge formed by the diodes D1, D2, D3, and D4. A common junction point of the coil L2' and the capacitor C2 is connected to a second input of said diode bridge. A first output of the diode bridge is connected to a second output by means of a capacitor C4. The second output is also connected to a ground terminal. The capacitor C4 is shunted by a series circuit of switching elements Q1 and Q2. The circuit portion DC is a control circuit for generating a control signal for rendering the switching elements Q1 and Q2 conducting and non-conducting, and vice versa, in alternation. A first output of the circuit portion DC is for this purpose connected to a control electrode of the switching element Q1. A second output of the circuit portion DC is connected to a control electrode of the switching element Q2. The switching element Q1 is shunted by a series arrangement of the coil L1, the capacitor C2, a lamp terminal K3, a lamp LA, a lamp terminal K4, and a sensor SE. The series arrangement of the coil L1, the capacitor C2, the lamp terminal K3, the lamp LA, the lamp terminal K4, and the sensor SE form a load branch. The lamp terminals K3 and K4 are connected to respective inputs of a circuit portion AD1. The circuit portion AD1 is a first analog-digital converter. Respective ends of the sensor SE (which is formed by an ohmic resistor) are connected to respective inputs of a circuit portion AD2. The circuit portion AD2 is a second analog-digital converter. An output of the circuit portion AD1 is connected to a first input of a circuit portion MULT. An output of the circuit portion AD2 is connected to a second input of a circuit portion MULT. The circuit portion MULT is a circuit portion for generating a signal which is a measure for the average value of the product of the digital signals present at the first and the second input of the circuit portion MULT. Such a signal is at the same time a measure for the average power consumed by the lamp over one cycle of the lamp current and is available at the output of the circuit portion MULT during operation of the circuit arrangement. The sensor SE and the circuit portions AD1, AD2, and MULT together form a sample circuit portion for sampling the actual value of the average power consumed by the lamp with a given frequency f. REFGEN is a circuit portion for generating a signal which is a measure for a desired value of the average power consumed by the lamp. The output of the circuit portion MULT is connected to a first input of a circuit portion SUBT. The output of the circuit portion REFGEN is connected to a second input of the circuit portion SUBT. The circuit portion SUBT is a circuit portion for generating an error signal with a value $E_n$ which is a measure for the difference between the actual value of the power consumed by the lamp and the desired value of the power consumed by the lamp. This error signal with a value $E_n$ is present at an output of the circuit portion SUBT during operation of the circuit arrangement. The output of the circuit portion SUBT is connected to an input of a circuit portion UGEN and to an input of a circuit portion MEM. The circuit portion UGEN is a circuit portion for generating a control signal with the value $U_n$ for which it is true that $U_n=U_n+K*E_n$ in which $U_{n-1}$ is the most recent value but one of the control signal and K is a proportionality factor. The average power consumed by the lamp in this example is an operational parameter which is controlled to a desired value by a digital control loop. The circuit portion MEM forms a memory for storing the most recent value $E_n$ of the error signal and the most recent value but one $E_{n-1}$ of the error signal. A first output of the circuit portion MEM, at which the most recent value $E_n$ of the error signal is present during operation of the circuit arrangement, is connected to a first input of a circuit portion COMP, to a first input of a circuit portion III, and to a first input of a circuit portion IV. A second output of the circuit portion MEM, at which the most recent value but one $E_{n-1}$ of the error signal is present during operation of the circuit arrangement, is connected to a second input of the circuit portion COMP and to a second input of the circuit portion IV. An output of the circuit portion COMP is connected to a third input of the circuit portion IV and to a second input of the circuit portion III. An output of the circuit portion III and an output of the circuit portion IV are connected to respective inputs of the circuit portion UGEN. The circuit portion COMP is a comparator for determining the sign of each of the error signals $E_n$ and $E_{n-1}$. The circuit portion III is a circuit portion for multiplying the proportionality factor K by a first predetermined value C1 greater than 1 if the error signals $E_n$ and $E_{n-1}$ are of equal sign and the absolute value of the error signal $E_n$ is greater than a predetermined value T1. The circuit portion IV is a circuit portion for multiplying the proportionality factor K by a third predetermined value C2 smaller than 1 if the error signals $E_n$ and $E_{n-1}$ are of unequal sign and the absolute value of the error signal $E_n$ or the absolute value of the error signal $E_{n-1}$ is greater than a second predetermined value T2.

The filter formed by the coils L2 and L2' and the capacitor C3, the diode bridge D1–D4, the capacitor C4, the switching elements Q1 and Q2, the circuit portion DC, the coil L1, the capacitor C2, and the lamp terminals K3 and K4 together form a first circuit portion I for generating a current through the lamp from a supply voltage delivered by the supply voltage source. The sensor SE and the circuit portions AD1, AD2, MULT, REGFEN, SUBT, and UGEN together form a digital control loop for controlling the power consumed by the lamp LA to a desired value. The circuit portions MEM, COMP, III, and IV together form a second circuit portion for influencing the value of the proportionality factor K.

The operation of the embodiment shown in FIG. 1 is as follows.

When the input terminals K3 and K4 are connected to a supply voltage source which delivers a low-frequency AC voltage, a DC voltage with a substantially constant value will be present across the capacitor C4. The circuit portion DC renders the switching elements Q1 and Q2 conducting and non-conduction, and vice versa, in alternation with a frequency $f_d$. A substantially square-wave voltage with a frequency $f_d$ is present at a common junction point of the switching elements as a result of this, and an alternating current also with a frequency $f_d$ flows in the load branch, i.e. also through the lamp LA. Between the inputs of the circuit portion AD1 obtains an analog signal which is a measure for the voltage across the lamp LA. This signal is sampled by the circuit portion AD1 in a certain sampling frequency f and converted into a digital signal which is a measure for the voltage across the lamp LA. The voltage across the sensor is an analog signal which is a measure for the current through the lamp LA. This signal is sampled by the circuit portion AD2, also with the sampling frequency f, and converted into a digital signal which is a measure for the lamp current. The circuit portion MULT generates a signal which is a measure for the value of the product of said two digital signals averaged over one cycle of the lamp voltage. The circuit portion REFGEN generates a signal which is a measure for the desired average value of the lamp power. The circuit portion SUBT generates an error signal with a value $E_n$ which is a measure for the difference between the signals generated by the circuit portion MULT and the circuit portion REFGEN. This error signal receives a new value each time in the rhythm of the preset sampling frequency. The circuit portion UGEN derives the control signal from the error signal, of which control signal the most recent value $U_n$ is equal to $U_{n-1}+K*E_n$, present at the input of the control circuit DC. The control circuit DC adjusts the duty cycle and/or the frequency of the control signal in dependence on the most recent value $U_n$ of the control signal. It is achieved thereby that the power consumed by the lamp is controlled to the desired value.

The memory MEM stores the most recent value of the error signal $E_n$ and the most recent value but one of the error signal $E_{n-1}$ and passes on these values via its outputs to the circuit portions COMP, III, and IV. The circuit portion COMP ascertains whether the signs of the most recent and most recent but one of the values of the error signal are equal or unequal and, depending on the outcome of this comparison, makes its output high or low, respectively. In the case of equal signs, the circuit portion III compares the absolute value of the most recent error signal $E_n$ with the first predetermined value T1. If the absolute value of the most recent error signal $E_n$ is greater than the first predetermined value T1, the circuit portion III increases the value of the proportionality factor K by multiplying the proportionality factor by the value C1. In the case on unequal signs of the most recent and most recent but one of the error signals, the circuit portion IV compares the absolute values of the most recent and most recent but one error signals with the second predetermined value T2. If one of said absolute error values is greater than T2, the circuit portion IV reduces the value of the proportionality factor K by multiplying the proportionality factor K by the value C2. A value is thus achieved for the proportionality factor K such that the control loop is stable and at the same time shows a comparatively quick response for a very wide range of parameters such as the power consumed by the lamp or the ambient temperature.

In a practical realization of the embodiment shown in FIG. 1, the digital control loop and the second circuit portion II were implemented by means of a microprocessor from the ST7 series from Thomson SGS, or the Philips 80C554.

Figure 2:
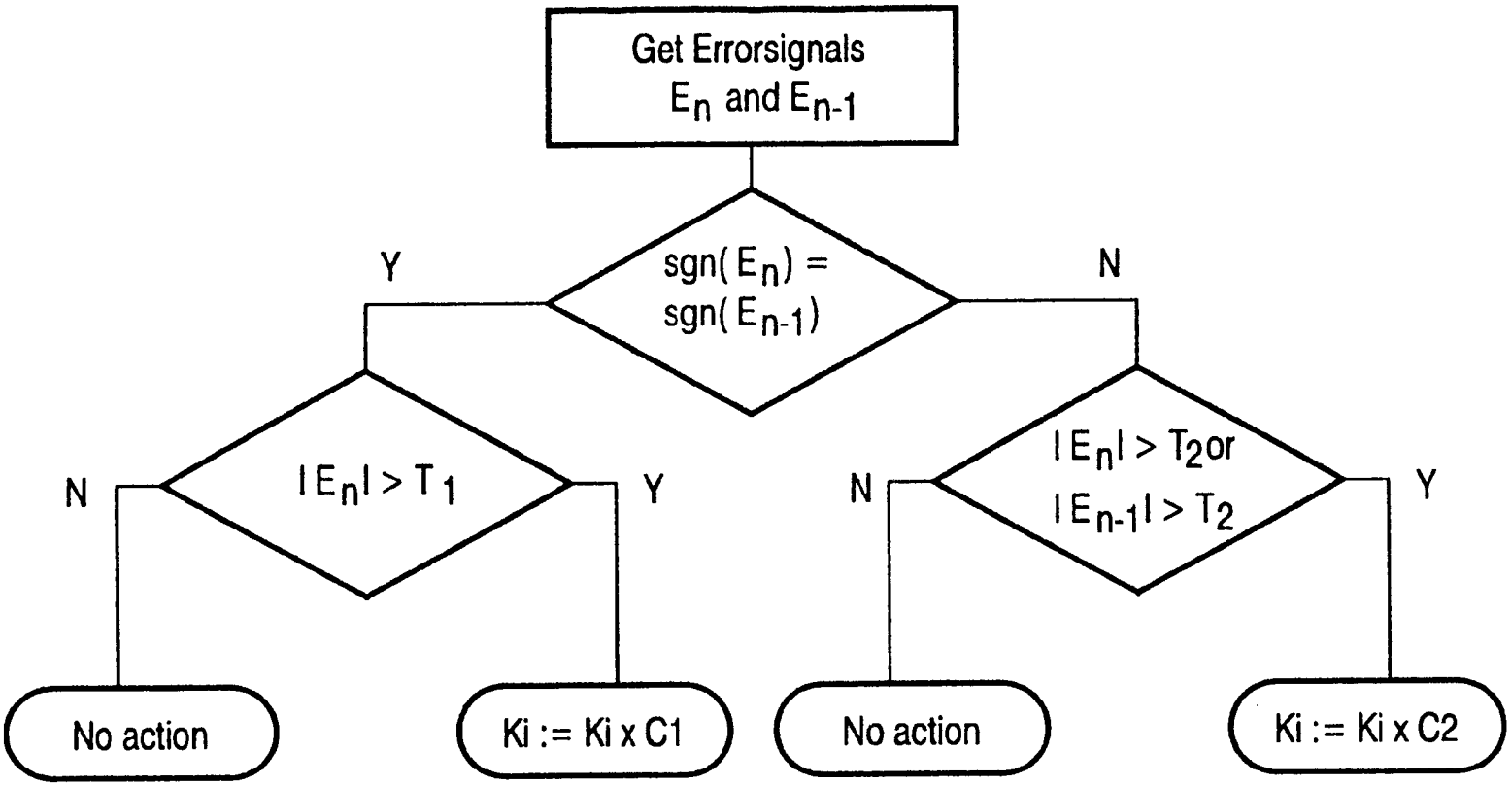
FIG. 2 is a flowchart showing the functions of part of the embodiment shown in FIG. 1.

FIG. 2 is a flowchart showing the operation of the second circuit portion II in the embodiment of FIG. 1.

What is claimed is:

1. A circuit arrangement for supplying a lamp, provided with input terminals for connection to a supply voltage source, a first circuit portion I for generating a current through the lamp from the supply voltage delivered by the supply voltage source, a digital control loop controlling an operational parameter to a desired value, provided with a sample circuit portion for sampling a actual value of the operational parameter with a predetermined frequency f, a control circuit portion for generating a control signal whose most recent value is $U_n$, provided with an integrating circuit portion for augmenting $U_{n-1}$ with $K*E_n$, with $U_{n-1}$, being the most recent value but one of the control signal, $E_n$ being the most recent value of an error signal which is a measure for the actual value of the operational parameter minus a desired value of the operational parameter, and K being a proportionality factor, a second circuit portion II for influencing the value of the proportionality factor K, provided with a memory for storing the most recent value $E_n$ of the error signal and a most recent value but one $E_{n-1}$ of the error signal, a comparator for determining a sign of each of the values of the error signal $E_n$ and $E_{n-1}$, a circuit portion III for increasing the proportionality factor K if the values $E_n$ and $E_{n-1}$ have the same sign, and a circuit portion IV for reducing the proportionality factor K if the values $E_n$ and $E_{n-1}$ have unequal signs.

2. A circuit arrangement as claimed in claim 1, wherein the control circuit portion is in addition provided with a proportional circuit portion for augmenting the most recent value but one of the control signal $U_{n-1}$ with $P*(E_n-E_{n-1})$, in which P is a proportionality factor.

3. A circuit arrangement as claimed in claim 2, wherein the circuit portion III is in addition provided with means for increasing the proportionality factor P if the values of $E_n$ and $E_{n-1}$ have the same sign, and wherein the circuit portion IV is in addition provided with means for reducing the proportionality factor P if the values of $E_n$ and $E_{n-1}$ have unequal signs.

4. A circuit arrangement as claimed in claim 1, 2, or 3, wherein the circuit portion III is provided with an activation circuit portion for activating the circuit portion III if an absolute value of the error signal, preferably chosen from the absolute values of $E_{n-1}$ and $E_n$, is greater than a preset value T1.

5. A circuit arrangement as claimed in claims 1 to 4, wherein the circuit portion IV is provided with an activation circuit portion for activating the circuit portion IV if an absolute value of the error signal, preferably chosen from the absolute values of $E_{n-1}$ and $E_n$, is greater than a preset value T2.

6. A circuit arrangement as claimed in claim 1 or 3, wherein the circuit portion III comprises means for multiplying one or more of the proportionality factors K and P by a predetermined value C1 greater than 1 if the values of $E_n$ and $E_{n-1}$ have the same sign, and wherein the circuit portion IV comprises means for multiplying one or more of the proportionality factors K and P by a predetermined value C2 smaller than 1 if the values of $E_n$ and $E_{n-1}$ have unequal signs.

7. A circuit arrangement as claimed in claim 6, wherein it is true that $1-C2>C1-1$.

8. A circuit arrangement as claimed in claim 1, wherein the second circuit portion II is provided with a microprocessor.

* * * * *